United States Patent [19]

Winyard

[11] Patent Number: 4,824,348

[45] Date of Patent: Apr. 25, 1989

[54] MULTIPLE TOOTH ENGAGEMENT SINGLE SCREW MECHANISM

[75] Inventor: David C. Winyard, Glen Burnie, Md.

[73] Assignee: The United States of America as represented by the Secretary of the Navy, Washington, D.C.

[21] Appl. No.: 908,859

[22] Filed: Aug. 27, 1986

[51] Int. Cl.[4] ..... F01C 3/08

[52] U.S. Cl. ..... 418/195; 418/196

[58] Field of Search ..... 418/195–197

[56] References Cited

U.S. PATENT DOCUMENTS

| | | | |
|---|---|---|---|
| Re. 30,400 | 9/1980 | Zimmern | 418/188 |
| 711,083 | 10/1902 | Taylor | 418/195 |
| 1,437,464 | 12/1922 | Carroll | 418/144 |
| 1,654,048 | 12/1927 | Myers | 418/195 |
| 1,723,157 | 8/1929 | Guttinger | 418/195 |
| 2,014,932 | 9/1935 | Hallett | 418/179 |
| 2,994,276 | 8/1961 | Matson | 418/195 |
| 3,133,695 | 5/1964 | Zimmern | 418/195 |
| 3,232,236 | 2/1966 | Karavias | 418/195 |
| 4,028,016 | 6/1977 | Keijer | 417/440 |
| 4,074,957 | 2/1978 | Clarke et al. | 418/159 |
| 4,227,867 | 10/1980 | Whitehill et al. | 418/97 |
| 4,261,691 | 4/1981 | Zimmern et al. | 417/440 |
| 4,373,881 | 2/1983 | Matsushita | 418/195 |

FOREIGN PATENT DOCUMENTS

| | | | |
|---|---|---|---|
| 2833292 | 2/1979 | Fed. Rep. of Germany | 418/195 |
| 757770 | 8/1980 | U.S.S.R. | 418/195 |

*Primary Examiner*—John J. Vrablik

*Attorney, Agent, or Firm*—Luther A. Marsh; John H. Stowe; Michael J. Gonet

[57] ABSTRACT

A single screw mechanism with a reduced differential pressure applied to the gaterotor teeth. This is accomplished by providing multiple tooth engagement of gaterotor teeth in a particular mainrotor compression chamber. Multiple tooth engagement makes possible the use of metallic gaterotor teeth and the elimination of gaterotor supports used to prevent the disengagement of gaterotor teeth due to high differential pressure.

3 Claims, 2 Drawing Sheets

MULTIPLE TOOTH ENGAGEMENT SINGLE SCREW MECHANISM

BACKGROUND OF THE INVENTION

The present invention relates to single screw mechanisms and more particularly to single screw mechanisms utilizing multiple tooth engagement.

In order to form single screw mechanisms it is known to make use of combinations comprising a mainrotor having a conical surface and projecting threads having a generally helicoidal shape, e.g. U.S. Patent to Zimmern Re No. 30,400. The crests of the threads are intended to cooperate with a casing, thereby forming compression chambers, and the mainrotor is adapted to cooperate with one or a number of gaterotors, the teeth of which are in meshing relation with the threads formed on the mainrotor.

The space formed between two adjacent threads of the mainrotor form a compression chamber which is sealed off at one end by a gaterotor tooth and at the other end by a casing closed end.

When fluid is sucked into the compression chamber, the rotation of the mainrotor permits a progressive reduction in the volume of the compression chamber, compressing the fluid until the compression chamber is put into communication with a casing outlet.

Current practice in the design and manufacture of single screw mechanisms to utilize only a single gaterotor tooth to seal off the mainrotor compression chamber at the intake side. Because of this practice the single gaterotor tooth must fit very closely in the mainrotor compression chamber to minimize internal leakage and to withstand the high differential pressure forces applied to the single gaterotor tooth. These factors have made necessary the use of thick nonmetallic gaterotor teeth, capable of plastically conforming to thread profiles, backed by metallic supports on the low pressure side, to provide adequate stiffness. An example of supported gaterotor teeth as are well known in the art is shown in German Pat. No. 28 33 292 to Zimmern issued Feb. 8, 1978 as shown in FIG. 2 of said German patent.

The casing window area required for the meshing of these thick gaterotor and support combinations with the mainrotor has limited the angle that mainrotor threads may wrap around the main rotor, i.e. wrap angle, to less than 360 divided by the number of gaterotors and limited the mainrotor to gaterotor gear ratio to a maximum of 6 to 17. Such low wrap angles create stronger discharge line pulsations, because only one gaterotor tooth seals each compression chamber, and low gear ratios create poor gaterotor tooth sealing shapes and high rubbing forces.

SUMMARY OF THE INVENTION

Accordingly, the present invention reduces differential pressure applied to the gaterotor teeth. This is accomplished by providing multiple tooth engagement of gaterotor teeth in a particular mainrotor compression chamber.

OBJECTS OF THE INVENTION

It is therefore an object of this invention to provide a single screw mechanism with reduced differential pressure on the gaterotor teeth.

A further object of the present invention is to provide a single screw mechanism with efficient high gear ratios.

Another object of the present invention is to provide a single screw mechanism which can utilize thin metallic gaterotors without supports for the gaterotor teeth.

Still a further object of the present invention is to provide a single screw mechanism with a relatively small casing window area.

BRIEF DESCRIPTION OF THE DRAWINGS

Other objects and many of the attendant advantages of the present invention becomes better understood by reference to the following detailed description with the appended claims, when considered in conjunction with the accompanying drawings, wherein:

DESCRIPTION OF THE PREFERRED EMBODIMENT

Figure 1:
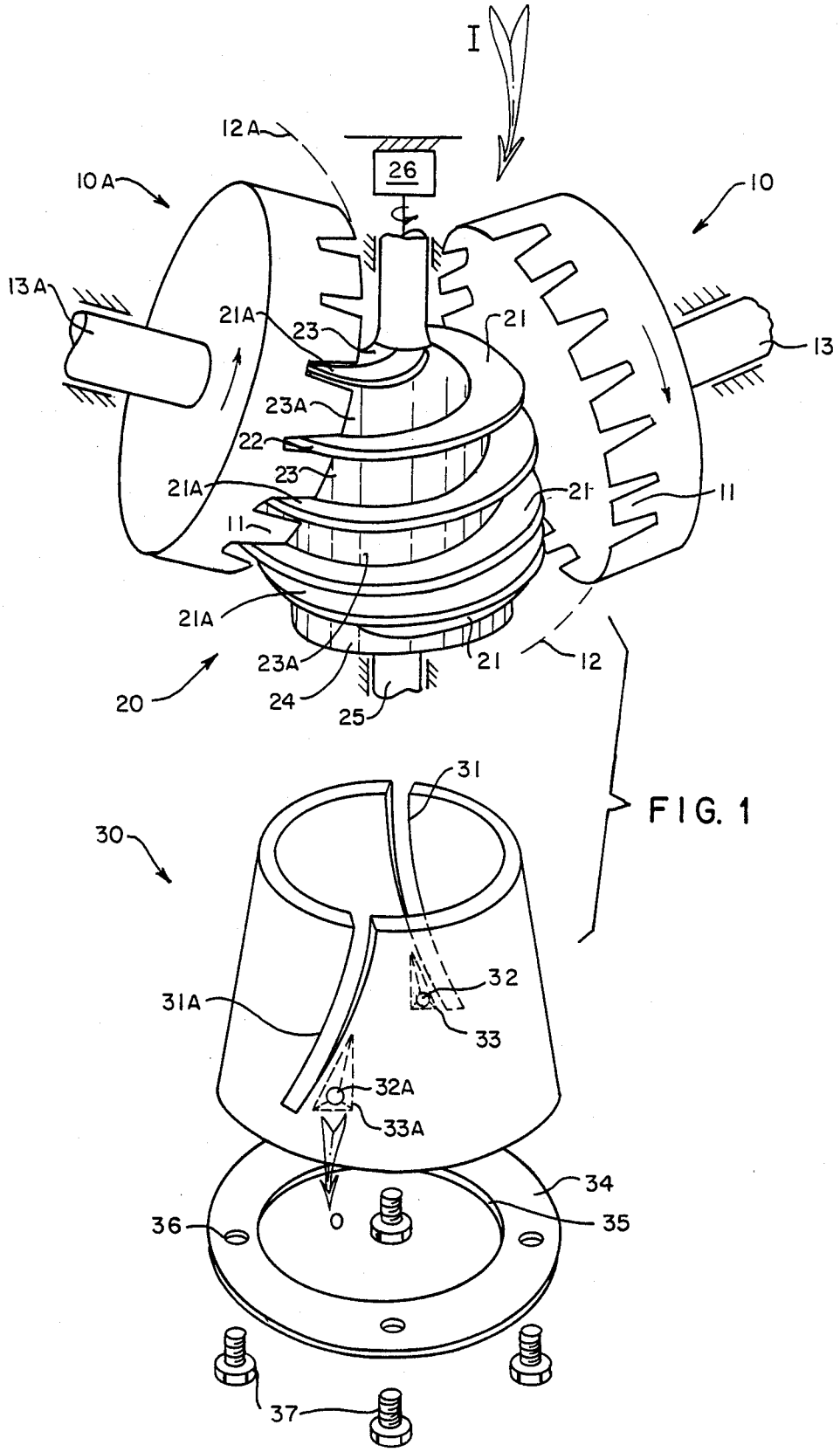
FIG. 1 is an exploded view in perspective showing the multiple tooth engagement single screw mechanism of the present invention.
Figure 2:
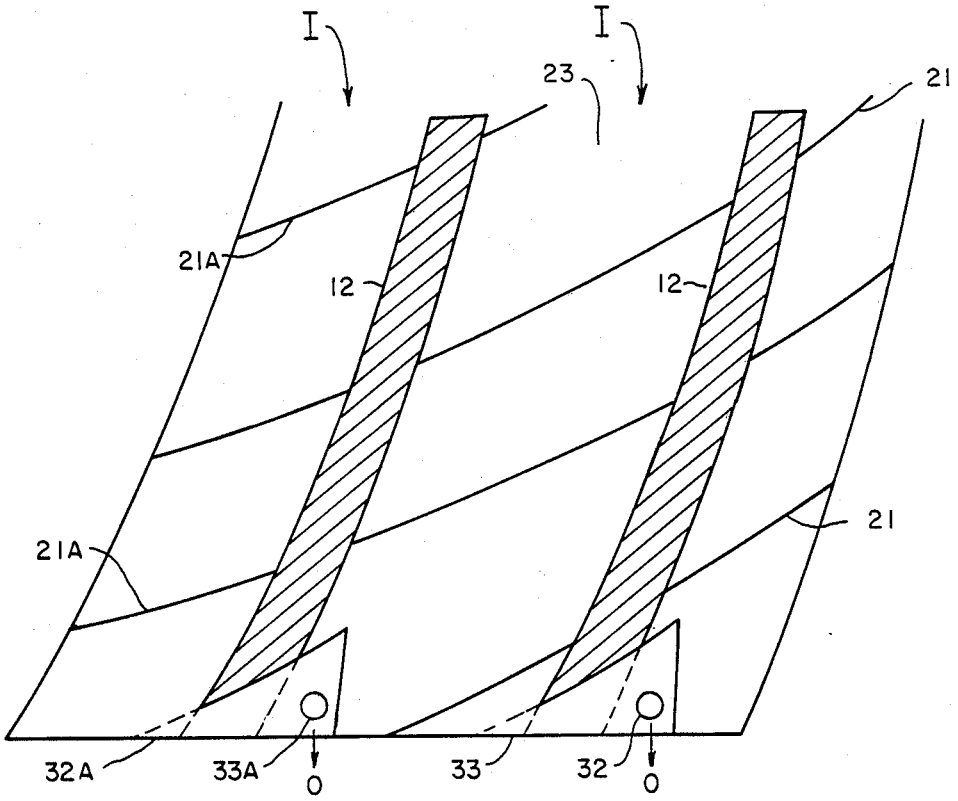
FIG. 2 is a developmental schematic view of a single screw mechanism of the present invention showing how the multiple tooth engagement concept is employed.

Referring now to the drawings wherein like reference characters designate like or corresponding parts throughout the several views, FIG. 1 shows a multiple tooth engagement single screw mechanism comprising a mainrotor 20, having mainrotor threads 21 and 21A, with a generally helicoid shape and provided with mainrotor integral shaft 25. Mainrotor threads 21 and 21A each wrap around the mainrotor at least one full turn and preferably two full turns. Mainrotor thread crests 22 are intended to cooperate with the interior of a casing 30, thereby forming mainrotor compression chambers 23 and 23A. Mainrotor 20 is adapted to cooperate with one or a number of gaterotors 10 and 10A. Mainrotor 20 is caused to rotate through operative connection with prime mover 26.

In the preferred embodiment, two gaterotors 10 and 10A are used and therefore the preferred embodiment will be described with reference to two gaterotors 10 and 10A. Gaterotors 10 and 10A function in substantially an identical manner. Gaterotors 10 and 10A each comprise gaterotor teeth 11 which are in meshing relation with the mainrotor threads 21 and 21A formed on mainrotor 20. Gaterotors 10 and 10A are provided with gaterotor integral shaft 13 and 13A, respectively. Gaterotor teeth 11 pass through casing 30 via casing gaterotor windows 31 and 31A to accomplish meashing. Gaterotor paths 12 and 12A generally denote the path of gaterotor and mainrotor meshing.

The space formed between two adjacent mainrotor threads 21 and 21A of the mainrotor 20 of this type can accordingly form a mainrotor compression chamber 23 and 23A which are sealed off at one end by a gaterotor tooth 11 and sealed off at the other end by providing the mainrotor with a mainrotor closed end 24.

When a fluid intake I such as air or gas, which can be at atmospheric pressure, is sucked into a mainrotor compression chamber 23 or 23A, the rotation of the mainrotor 20 permits a progressive reduction in the volume of the mainrotor compression chambers 23 and 23A until the mainrotor compression chambers 23 or 23A are put into communication with casing fluid outlet means 33 and 33A which can be formed in the casing 30. In a compressor the chamber's volume would be reduced during rotation while in a liquid pump its volume would remain constant until it is exposed to the outlet. The pocket's volume history may be determined by selection of a mainrotor/casing shape and other geometric parameters to obtain the desired result. Fluid outlet means 33 and 33A comprise fluid outlet bores 32 and 32A for channeling outlet fluid O.

Casing 30 is generally of a hollow conical shape. Gaterotor casing windows 31 and 31A, which extend radially and axially from the top of the casing 30, are provided to allow for gaterotors 10 and 10A to mesh with mainrotor 20. Gaterotor casing window substantially conform to the angular arcs of gaterotor paths 12 and 12A. A casing plate 34 is fixedly attached to the bottom of casing 30 thereby allowing for assembly of the compressor. Fastening means, such as cap screws 37, secure casing plate 34 to casing threaded bores, not shown, via casing plate bores 36. Casing plate 34 further comprises an inner diameter 35 which provides pressure sealing with mainrotor closed end 24.

Figure 3:
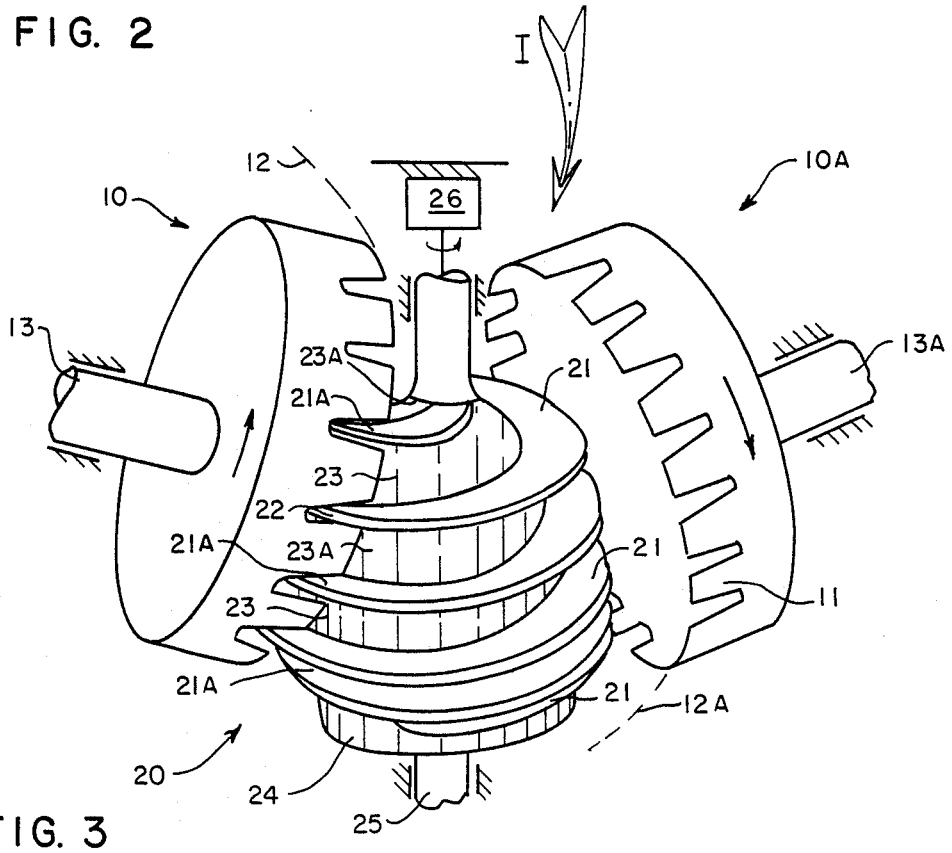
FIG. 3 is a second view of a portion of FIG. 1 showing a portion revolved to show the side opposite from that shown in FIG. 1.

Referring now to FIG. 1 and FIG. 3, in operation it is readily seen that the invention provides compression chambers 23 and 23A which are sealed off from the intake side of compression chambers 23 and 23A by a plurality of gaterotor teeth 11. Gaterotor tooth paths 12 and 12A denote where along the compression chambers 23 and 23A the gaterotor teeth 11 mesh with the mainrotor 20 to provide sealing.

Each compression chamber 23 and 23A is sealed twice by one gaterotor and once by the other gaterotor. When FIG. 1 and FIG. 3 are viewed simultaneously, it is seen that compression chamber 23 is sealed twice by the teeth 11 of gaterotor 10 and once by the teeth 11 of gaterotor 10A and compression chamber 23A is sealed twice by the teeth of gaterotor 10A and once by the teeth 11 of gaterotor 10.

This multiple tooth engagement concept provides compression chambers 23 and 23A which exert a relatively low differential pressures across gaterotor teeth 11. It will be readily apparent in the light of this disclosure that with multiple teeth 11 engaged in a compression chamber 23 or 23A, the pressure difference between the outlet and the inlet will be divided such that a portion of the pressure will be across each of the teeth which is engaged in a compression chamber 23 or 23A. The multiple tooth engagement concept further allows for the use of thinner gaterotors 10 and 10A which can now utilize metal and no longer have to rely on gaterotor supports, as were required in the prior art.

Although the preferred embodiment has been described with respect to an apparatus comprising two operative gaterotors, an apparatus comprising a single gaterotor is also within the scope of this invention. Such an apparatus would, of course, utilize only one of the gaterotors 10 or 10A as appropriate and only one of the output windows 32 or 32A. Thus, although a compression chamber 23 or 23A may still be sealed simultaneously by more than one tooth of the same gaterotor, it may not be sealed by more than one tooth of one gaterotor and another one tooth of another gaterotor.

Obviously, other embodiments and modifications of the present invention will readily come to those of ordinary skill in the art having the benefit of the teachings presented in the foregoing description of the drawings. It is therefore, to be understood that this invention is not to be limited thereto and that said modifications and embodiments are intended to be included within the scope of the appended claims.

What is claimed and desired to be secured by Letters Patent of the United States is:

1. A single screw mechanism having an inlet and an outlet, comprising:
   - a conical mainrotor formed with a plurality of threads, each said thread having a thread wrap angle around said mainrotor of at least one full turn;
   - a casing, cooperating with said mainrotor threads, forming at least one chamber, each said chamber in fluid communication at a first end with said inlet of said single screw mechanism and in fluid communication at a second end with said outlet of said single screw mechanism;
   - a plurality of cylindrical gaterotors having teeth which are in meshing relation with said mainrotor threads, said gaterotor teeth sealedly cooperating with each said chamber such that said first end of said chamber is sealed from each said second end of said chamber by a plurality of teeth of one gaterotor and at least one tooth of another gaterotor for at least a portion of each cycle.

2. The mechanism of claim 1 wherein the gaterotor teeth are of relatively thin design.

3. The mechanism of claim 2 wherein the gaterotors are metallic.

* * * * *